US006439786B1

(12) United States Patent
Hasiuk

(10) Patent No.: US 6,439,786 B1
(45) Date of Patent: Aug. 27, 2002

(54) SYNCHRONIZED MOTION PRINTER WITH CONTINUOUS PAPER MOVEMENT

(75) Inventor: Peter Hasiuk, Enfield, CT (US)

(73) Assignee: Scanvec Garment Systems, Ltd., Tel Aviv (IL)

( * ) Notice: Subject to any disclaimer, the term of this patent is extended or adjusted under 35 U.S.C. 154(b) by 0 days.

(21) Appl. No.: 09/665,083

(22) Filed: Sep. 20, 2000

Related U.S. Application Data

(60) Provisional application No. 60/154,856, filed on Sep. 20, 1999.

(51) Int. Cl.[7] ..... B41J 11/26
(52) U.S. Cl. ..... 400/611; 400/614
(58) Field of Search ..... 400/611, 613, 400/614, 185

(56) References Cited

U.S. PATENT DOCUMENTS

| | | | | |
|---|---|---|---|---|
| 1,825,783 A | * | 10/1931 | Dunning et al. | 400/614 |
| 4,407,595 A | | 10/1983 | Gershnow | 400/212 |
| 4,776,715 A | | 10/1988 | Takada et al. | 400/323 |
| 4,990,004 A | | 2/1991 | Kawahara et al. | 400/56 |
| 5,455,604 A | | 10/1995 | Adams et al. | 346/138 |
| 5,506,606 A | | 4/1996 | Saikawa et al. | 346/134 |
| 5,788,383 A | * | 8/1998 | Harada et al. | 400/185 |
| 5,842,795 A | * | 12/1998 | Narita et al. | 400/185 |
| 6,056,454 A | | 5/2000 | Plumley et al. | 400/120.16 |
| 6,076,983 A | | 6/2000 | Stein et al. | 400/611 |

OTHER PUBLICATIONS

International Search Report for International Application No. PCT/IB00/01485, Filing Date Sep. 20, 2000.

* cited by examiner

*Primary Examiner*—Eugene Eickholt
(74) *Attorney, Agent, or Firm*—Alix, Yale & Ristas, LLP

(57) ABSTRACT

A printer including a single motor which provides rotary motion to a feed drum having an outer surface which frictionally engages and pulls a web material from a roll rotatably mounted on a supply shaft. First and second pendulum systems, each including two pendulums independently mounted to the frame, pivotally mount a take-up shaft and a tension roller to tension the web as it comes off the feed drum and the roll, respectively. A print head carriage assembly is moveable along a pivot beam which extends orthogonally across the linear path from a first end position to a second end position. The single motor is coupled to the print head carriage assembly for reciprocally pushing and pulling the print head carriage assembly between first and second end positions. An actuator selectively pivots the pivot beam such that the first end portion of the pivot beam is pivoted in the direction of the linear path when the print head carriage assembly is disposed for moving from the second end position to the first end position and the second end portion of the pivot beam is pivoted in the direction of the linear path when the print head carriage assembly is disposed for moving from the first end position to the second end position.

22 Claims, 6 Drawing Sheets

SYNCHRONIZED MOTION PRINTER WITH CONTINUOUS PAPER MOVEMENT

Applicant incorporates by reference and claims benefit pursuant to 35 U.S.C. 119(e) for Provisional Patent Application titled Synchronized Motion Printer With Continuous Paper Movement, Ser. No. 60/154856, filed Sep. 20, 1999.

BACKGROUND OF THE INVENTION

This invention relates generally to printers for use with a web of paper or other sheet material which travels along a fixed linear path. More particularly, the present invention relates to printers of the type where a print device or other drawing instrument is traversed across the width of the web, in a direction perpendicular to the direction of the linear path of the web, to draw figures, characters, and other graphics on the sheet material.

Traditional printers utilizing a traversing head mechanism cause the print head to traverse across the web of paper while moving paper in one of three operational modes: 1) intermittent paper movement; 2) continuous paper movement; or 3) a combination of intermittent paper movement combined with continuous paper movement. In each of these three operational modes to date, the linear paper movement and the traversing movement are monitored independently and utilize electronic means for controlling each of these motions while also providing a means for electronically interlocking the two motions.

In the first mode of operation, the print head accelerates to a printing velocity while traversing across the paper web perpendicular to the length of the web while the paper remains stationary. A position encoder driven by the print head drive motor is used to provide timing information for the incremental placement of the print pattern on the paper. When the print head reaches the end of the printable band, the motor controlling the traversing motion of the print head brings the print head to a controlled stop. While the print head is being stopped, the paper is advanced an amount equal to the vertical height of the printed band. This motion is controlled by an independent motor drive and is monitored by an independent encoder or position transducer which directly or indirectly measures paper movement. When the paper reaches the next print position, the print head motor reverses the traversing direction and then repeats the acceleration, print and deceleration process. This cycle repeats for each required print band. The paper advance motor or an independent paper take-up motor is used to rewind the printed web while a separate means for tension control of the web is provided in most systems.

In the second operational mode, the paper is first placed in motion in one direction prior to or simultaneously with the beginning of the print head traversing cycle. The traversing angle in this case is not horizontal or zero degrees as in the first case, but is determined by the ratio of the linear paper speed and the traversing speed of the print head. This angle is required in order to generate a horizontal print band on the moving paper and is obtained by driving the print head with an x-direction and a y-direction drive mechanism. The traversing motor driving the print head in the x-direction will have the same acceleration, print, deceleration, stop, and reverse characteristics as the first case. Electronic synchronization of the paper feed and the traversing feed (x-direction) motors along with an additional means for controlling and synchronizing the displacement of the print head in the paper direction (y-direction) for creating the required traversing angle is required. At the end of two traversing passes or one complete right and left traversing pass across the web, the y-direction drive mechanism that creates the traversing angle must be reset to it's original home position to enable the cycle to repeat. This function usually utilizes a separate actuating device and requires high acceleration forces.

The third operational mode uses mode 2 but permits the paper and traversing mechanism to stop at the end of any printed line.

All three of the operational modes described above utilize relatively expensive servo mechanisms for synchronizing two or more axis of motion in order to obtain the required printing precision at high speeds. In addition, as the speed requirement of the printer increases, significantly higher accelerations for starting, stopping, and reversing the traversing motion require even more expensive mechanisms and typically reduce the reliability of the printer due to the increased loads resulting from the high accelerations associated with this type of traversing motion.

SUMMARY OF THE INVENTION

Briefly stated, the invention in a preferred form is a printer for printing on a web of material moving continuously in a single direction along a linear path. The printer includes means for advancing the web of material along the linear path and means for printing on the web of material along a print path extending across the linear path. A single motor provides the motive power for advancing the material along the linear path and for reciprocally pushing and pulling the print means between first and second end positions adjacent the opposite first and second sides of the linear path.

The advance means includes a feed drum which is rotatably mounted to the frame of the printer and has an outer surface which frictionally engages and pulls the web material along the linear path. The printer also includes means for tensioning the web of material as it is advanced along the linear path. The tensioning means includes a take-up shaft and means for moveably mounting the take-up shaft to the frame. A leading end of the web of material extending between the take-up shaft and the feed drum is mounted to the take-up shaft such that the web material is wound on the take-up shaft during the printing operation.

The advance means further includes a supply shaft which is mounted to the frame for rotatably mounting a supply roll of web material. The tensioning means further includes a paper tension roller and means for moveably mounting the paper tension roller to the frame. The paper tension roller has an outside surface adapted which engages the web material disposed intermediate the supply shaft and the feed drum.

The means for moveably mounting the take-up shaft and the means for moveably mounting the paper tension roller each include a pair of pendulum arms. Each of the pendulum arms has oppositely disposed first and second end portions, with the first end portion of each pendulum arm being independently pivotally mounted to the frame. The take-up shaft and the paper tension roller are each rotatably mounted to the second end portions of the respective pendulum arms.

The print means includes a pivot beam which extends orthogonally across and adjacent to the linear path of the web. At least one print head is supported on the pivot beam and is moveable along the pivot beam between the first and second end positions. Means are provided for selectively pivoting the pivot beam such that a first end portion of the pivot beam is pivoted in the direction of the linear path when the print head is disposed for moving from the second end position to the first end position and a second end portion of the pivot beam is pivoted in the direction of the linear path when the print head is disposed for moving from the first end position to the second end position.

A drive pulley and an idler pulley are rotatably mounted at the first and second end portions of the pivot beam, respectively, with the output of the motor being coupled to the drive pulley. A drive belt carried on the drive and idler pulleys is driven by the drive pulley in a single direction. The drive belt is linked to the print means for reciprocally pushing and pulling the print head between the first and second end positions.

First and second eccentric cams are rotatably mounted at the first and second end portions of the pivot beam, respectively, and engage with fixedly mounted first and second cam supports, respectively. The first and second eccentric cams each have a cam lobe, with the cam lobe of the second eccentric cam being located 180° from the cam lobe of the first eccentric cam. Trip means connected to the drive belt selectively rotates the first and second eccentric cams such that the cam lobe of the first eccentric cam engages the first cam support to pivot the first end portion of the pivot beam in the direction of the linear path when the print head is disposed for moving from the second end position to the first end position and the cam lobe of the second eccentric cam engages the second cam support to pivot the second end portion of the pivot beam in the direction of the linear path when the print head carriage assembly is disposed for moving from the first end position to the second end position.

It is an object of the invention to provide a new and improved printer for printing on a web of continuously moving material.

It is also an object of the invention to provide a printer having a paper advance system which provides a constant tension on the paper web in spite of variations in web tension and thickness.

It is further an object of the invention to provide a printer having horizontal print density and accuracy of the printed horizontal line which is independent of the throughput.

It is also further an object of the invention to provide a printer having a significantly lower power consumption than conventional printers.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
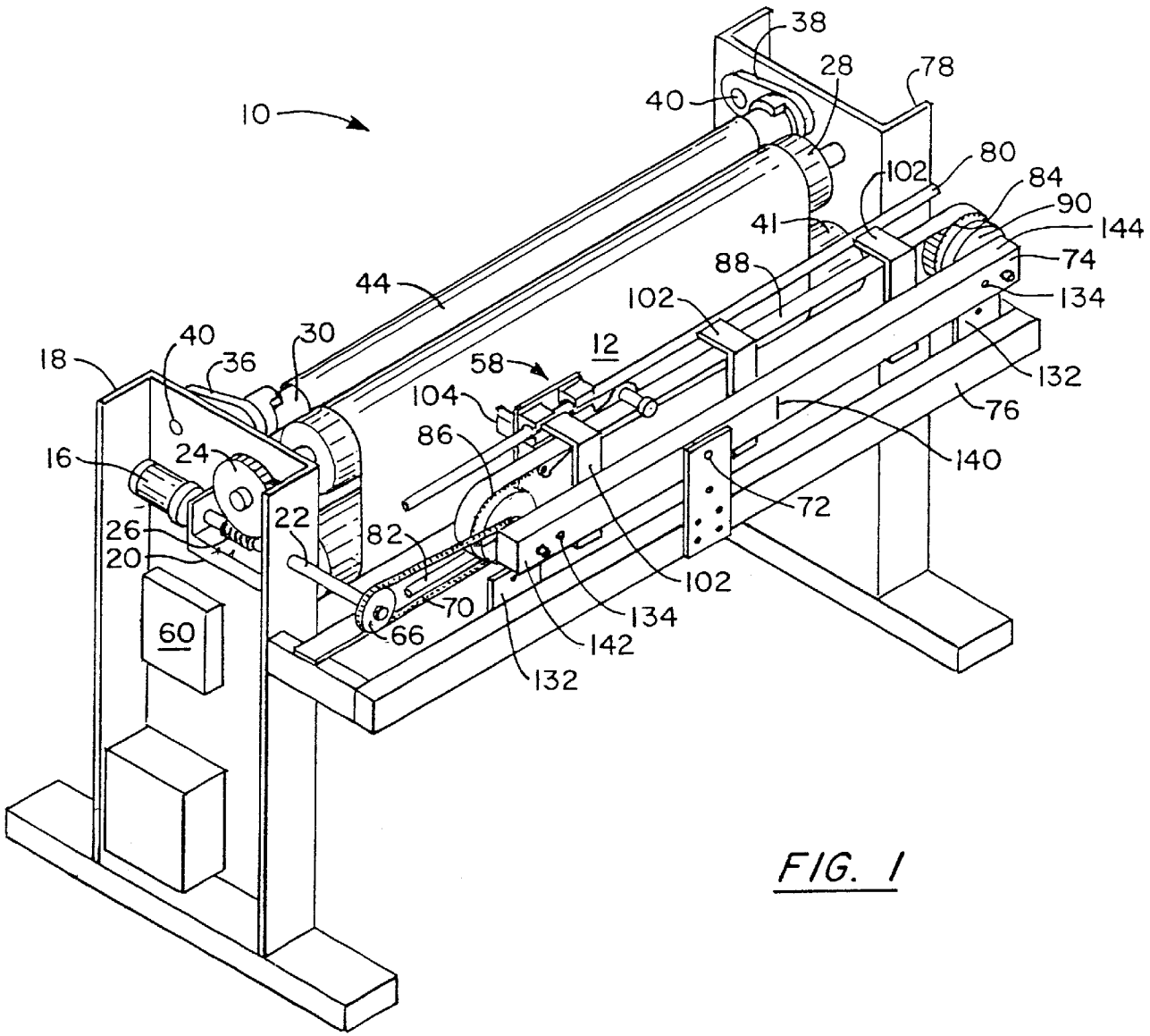
FIG. 1 is an isometric view of a printer in accordance with the invention, with all external covers removed.

With reference to the drawings wherein like numerals represent like parts throughout the several figures, a synchronized motion printer with continuous paper movement in accordance with the present invention is generally designated by the numeral 10. A synchronized motion printer 10 with continuous paper movement (hereinafter a "synchronized motion printer") is a printer where a drawing of great length is produced by placing a web 12 composed of paper in a continuous linear motion while simultaneously traversing the print head across the web 12 of paper at an angle which is determined by the ratio of the paper speed and the traversing speed of the print head, without the need to independently measure, control, and synchronize these motions. It should be appreciated that synchronized motion printers 10 are useful for printing on webs consisting of materials other than paper, for example plastic or fabric.

Synchronized motion printers 10 are useful, for example, in the garment industry for drawing markers showing pattern pieces to be cut from a length of fabric. In such applications, the printer 10 may be part of a computer assisted pattern grading and marker making system. In this case the sheet material on which the drawing or marker is made is usually paper and the writing instrument is usually a multi-nozzle ink jet print head. Therefore, for convenience, in the following description and in the accompanying drawings, the sheet material referred to and shown is paper, and the writing instrument referred to and shown is an ink jet print head consisting of a vertical array of 128 nozzles placed on 0.0054 inch centers. Other sheet materials and conventional writing instruments may however be used without departing from the invention.

Figure 2:
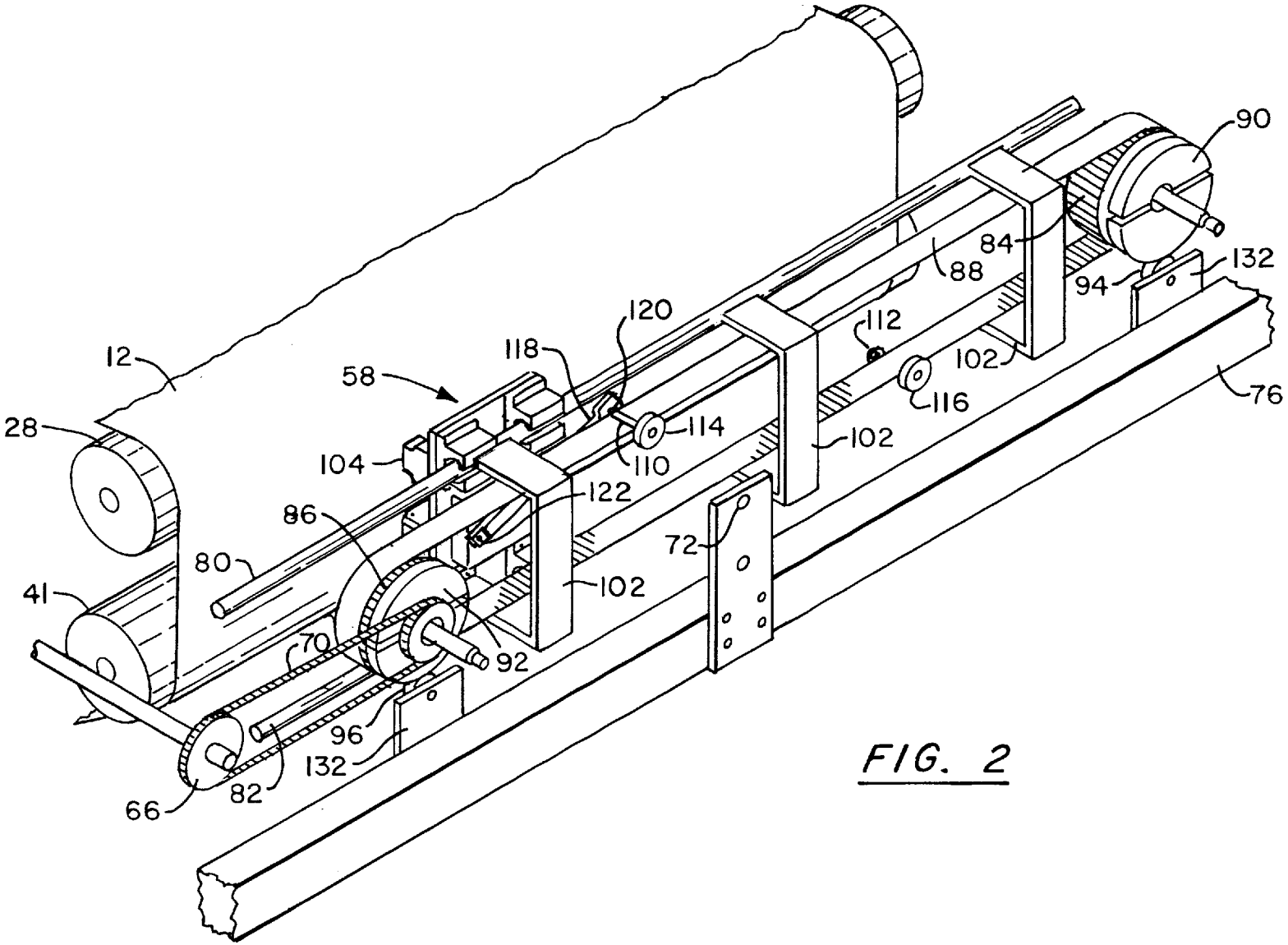
FIG. 2 is a simplified version of FIG. 1, showing only those elements supported by the pivoting beam.

With reference to FIGS. 1 and 2, the synchronized motion printer 10 includes a paper advance system 14 having a single drive source for the printer 10, motor 16, which is mounted on the left printer support channel 18 via a support block 20. In a preferred embodiment, the motor 16 is directly coupled to the main drive shaft 22 and drives a paper advance worm gear 24 through a worm drive 26 pinned to drive shaft 22 at a 100:1 speed ratio. The paper advance worm gear 24 is attached to the end of a rubber coated paper feed drum 28 that advances the paper web 12, which is partially wrapped around paper feed drum 41. This high reduction ratio provides for the slow and continuous movement of paper web 12 while significantly reducing the reflected inertia and torque requirements seen by drive motor 16.

The friction force needed to advance the paper web 12 is applied to the paper web 12 as a result of the normal force created by the weight of the rewound paper 44 and the weight of the paper take-up shaft 30 resting on the paper feed drum 28. A high-resolution encoder 32 is coupled to the print head carriage assembly 58 and precisely monitors the horizontal print head movement.

The two ends of the take-up shaft 30 are mounted to the support channels 18, 78 by a first free-floating mount system 33 which allows each end of the take-up shaft 30 to move independently, relative to the feed drum 28. In a preferred embodiment, the first free-floating mount system 33 is a first pendulum system 34 (FIG. 4), consisting of first and second pendulum arms 36, 38, pivoting independently at each end of the printer on pendulum pivot bearings 40 supports paper take-up shaft 30. The leading edge of the paper web 12 exiting between the paper take-up shaft 30 and the paper feed drum 28 is attached to the paper take-up shaft 30, such that the paper web 12 is automatically rewound on the paper take-up shaft 30 whenever the paper feed drum 28 rotates. The portion of the rewound paper 44 disposed intermediate the take-up shaft 30 and the paper feed drum runs in contact with both the take-up shaft 30 and the paper feed drum 28, such that the displacement of the paper web 12 exiting the paper feed drum 28 is equal to the displacement of the rewound paper 44 winding on the takeup shaft 30, rewinding the paper web 12 with minimal tension. The independently pivoting pendulum arms 36, 38 minimize paper feeding errors due to variations in web tension and paper thickness along the width of the web 12. Higher tension or thinner paper along the width of the web 12 result in variations in the diameter of the rewound paper 44 (from side to side) on the take-up shaft 30. In a system which does not have independently moving pendulum arms, portions of the rewound paper 44 having reduced diameter, as compared with other portions of the rewound paper 44, will lose contact with the feed drum, resulting in movement of the web 12 in the smaller diameter portions and uneven windup. Alternatively, the free-floating mount system 33 may comprise a slot (not shown) in each support channel 18, 78 which allow the ends of the take-up shaft 30 to be displaced relative to the feed drum 28.

Figure 4:
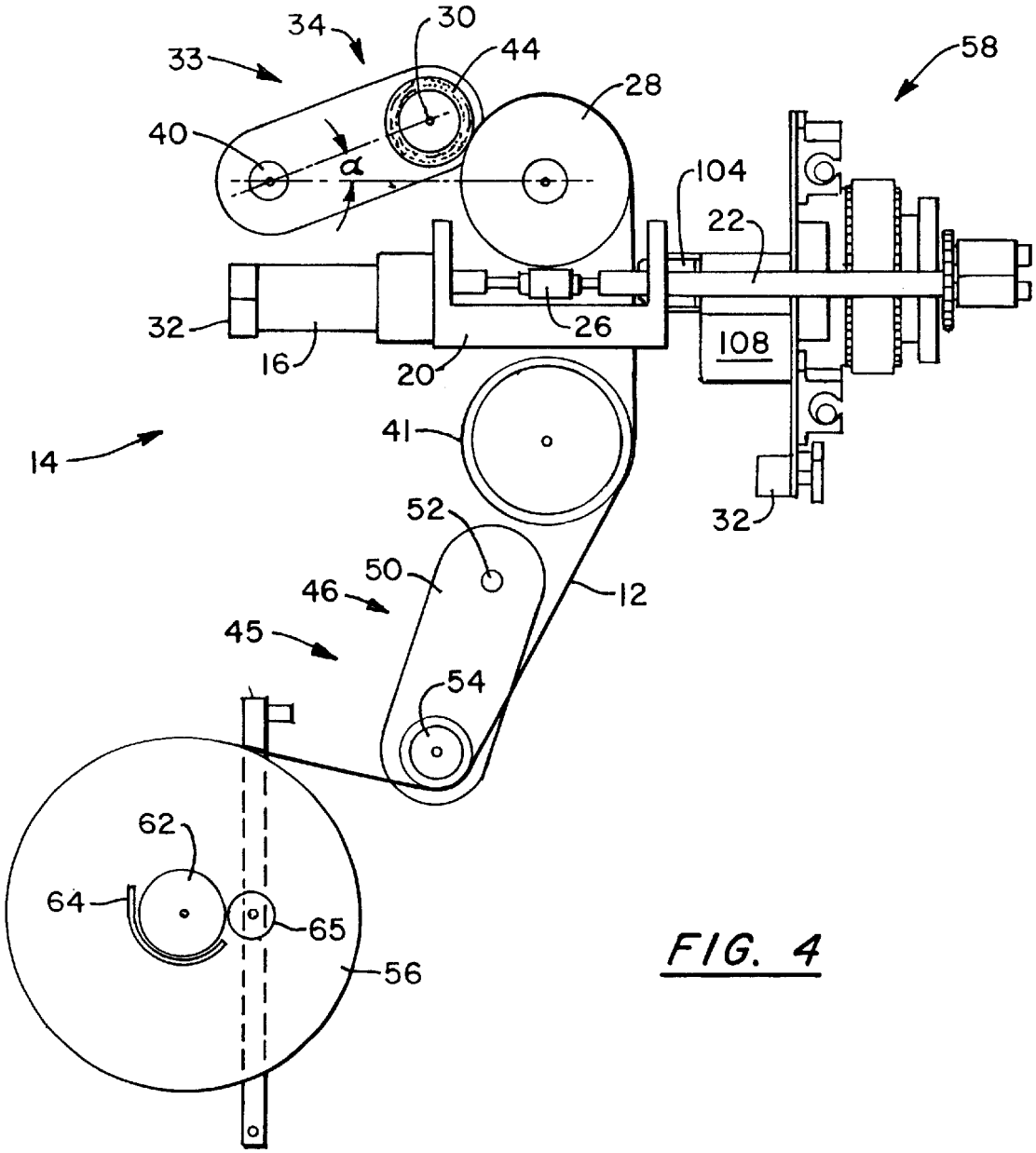
FIG. 4 is a side view of the printer of FIG. 1, with the support channel removed to illustrate the means for paper feed and paper take.

With reference to FIG. 4, the pendulum configuration of the first pendulum system 34 also provides a self compensating system that applies a relatively constant normal force to the paper web 12 as the weight of the rewound paper 44 on the take-up shaft 30 increases. The normal force applied to the paper web 12 is a function of the sum of the weight of the paper take-up shaft 30 and the rewound paper 44 on the take-up shaft 30, the coefficients of friction of the paper feed drum 28 and the paper web 12, the tension applied to the supply end of the paper web 12, and the effective angle of contact a between the outside diameter of the rewound paper 44 on the paper take-up shaft 30 and the paper feed drum 28. When there is little or no rewound paper 44 on the paper take-up shaft 30, the angle of contact a is very small and the resulting normal force is magnified and becomes greater than the combined weight of the paper take-up shaft 30 and the rewound paper 44.

As the paper web 12 winds onto the paper take-up shaft 30, the diameter of the rewound paper 44 continues to increase along with the weight of the rewound paper 44. The increasing diameter of the rewound paper 44 causes the pendulum arms 36, 38 to rotate around the center of the pendulum pivot bearings 40 increasing the angle of contact a between the rewound paper 44 on the paper take-up shaft 30 and the paper feed drum 28. This increasing angle compensates for the increased weight of the rewound paper 44 on the paper take-up shaft 30, and maintains a relatively constant force on the paper feed drum 28, independent of the amount of rewound paper 44 on the paper take-up shaft 30.

The length of the pendulum arms 36, 38, the location of the pendulum pivot bearings 40, the initial contact angle without rewound paper 44, and the contact angles defined by the rewound paper 44 provide the variables that enable the first pendulum system 34 to maintain a relatively constant normal force for all rewound paper 44 take-up diameters. This constant normal force is essential to maintain consistency of paper feeding. An alternative embodiment for the takeup function is to permit the paper web 12 to exit directly from between the paper take-up shaft 30 and the paper feed drum 28. The paper web 12 can then be fed directly to the floor, to a take-up tray, or to an auxiliary take-up device.

A second free-floating mount system 45 which allows each end of a paper tension roller 54 to move independently, relative to the paper supply roll 56. In a preferred embodiment, the second free-floating mount system 45 is a second pendulum system 46, consisting of third and fourth pendulum arms 48, 50, pivoting at each end of the printer on pendulum pivot bearings 52, supports paper tension roller 54. The paper tension roller 54 is positioned intermediate the paper supply roll 56 and the print head carriage assembly 58 and engages the paper web 12 as it comes off of the paper supply roll 56. The pivoted connections allow either end of the paper tension roller 54 to be displaced relative to the paper supply roll 56 to allow for takeup variations in the tension of the web of paper wound on the roll 56 and thereby provide a constant tension on the paper web 12 in spite of such variations. The first and second pendulum systems 34, 46 apply a constant tensioning force to the paper web 12, thereby eliminating paper stretch and preventing the formation of waves, thereby maintaining the accuracy of the print data along the length of paper web 12.

In summary, paper web 12 is driven continuously in one direction by applying power to the drive motor 16 under the control of the printer controller 60. The diameter of the paper feed drum 28 and the speed of the main drive shaft 22 determine the advance speed of the paper web 12. Paper tension is obtained from the friction created between the paper supply shaft 62 and the tension support blocks 64 resulting from the weight of the paper supply roll 56 and the paper supply shaft 62 resting on the tension support blocks 64. Additional tension of the web is achieved with adjustable pressure rollers 65 that engage shaft 62 within each support block 64. The printing on the paper web 12 is performed while the paper web 12 is in motion.

Figure 3:
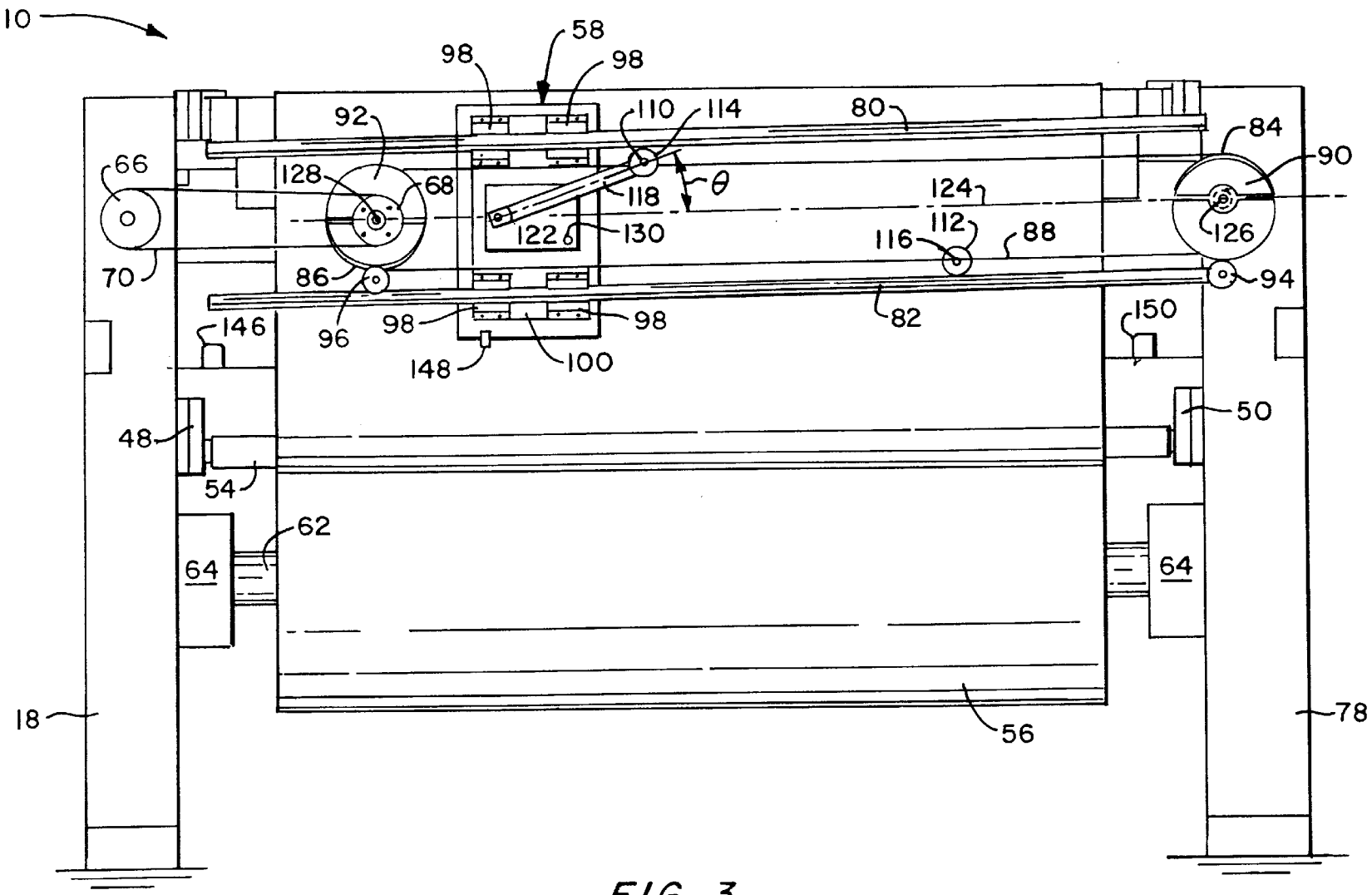
FIG. 3 is a plan view of the printer of FIG. 1, with the pivoting and fixed beams removed to illustrate the elements of the invention behind the beams.

Referring to FIGS. 2 and 3, the main drive shaft 22 drives a primary drive sprocket 66 that is attached to the end of the main drive shaft 22. The primary drive sprocket 66 is coupled to the driven sprocket 68 through a drive chain 70 with a 6:5 ratio. The drive chain 70 is of sufficient length to permit the driven sprocket 68 to be displaced vertically as the driven sprocket 68 and the print guidance system are pivoted around pivot shaft 72, seen in FIG. 1, and repositioned at the end of each printed line.

In a preferred embodiment, the pivot beam 74 is supported by a rigid fixed beam 76, which is attached to the two printer side channels 18, 78, and pivots about the pivot shaft 72. The pivot beam 74 supports the print head carriage assembly 58 shown in FIG. 3, the linear guide rails 80, 82 (best viewed in FIG. 3), the print head idler and drive pulleys 84, 86, the print head drive timing belt 88, and the pivot control eccentric cams 90, 92. As described in greater detail below, the pivot control eccentric cams 90, 92 rest on cam supports 94 and 96. Therefore, it should be appreciated that the pivot beam 74 is not required to be pivotally connected to the fixed beam 76.

As shown in FIG. 3, the print head carriage assembly 58 is guided parallel to the centerline of the pulleys 84, 86 by four linear bearings 98 attached to the print head carriage plate 100 and running on two parallel linear guide rails 80, 82. The linear guide rails 80, 82 are supported on the pivot beam 74 by means of several "C"-channel brackets 102. Attached to the print head carriage plate 100 is the ink jet print head 104 oriented with the print nozzles 106 (FIG. 5) along the vertical length or motion of the paper web 12. Also attached to the print head carriage plate 100 is the ink reservoir 108.

Referring to FIG. 2, the timing belt 88 is driven by the left, first print head drive pulley 86, which is coupled to the driven sprocket 68. Attached to the timing belt 88 are two trip pins 110, 112 which are located exactly 180 degrees apart from one another along the circumference of the timing belt 88. Both trip pins 110, 112 have a cam actuating bearing 114, 116 attached to one end. The primary trip pin 110 also has a link arm 118 attached to the side opposite the cam actuating bearing 114. The link arm 118 alternately pushes and pulls the print head carriage plate 100 along the linear guide rails 80, 82 as the timing belt 88 rotates in a clockwise direction as viewed from the front of the printer 10. The right end of the link arm 118 is attached to the primary trip pin 110 through a trip pin link bearing 120, while the left end is attached to the print carriage plate 100 through a carriage support bearing 122 with the location of this bearing set along the horizontal center line 124 defined by the axis 126, 128 of the print head idler and drive pulleys 84, 86. It should be appreciated that drive means other than a timing belt 88 may also be used. For example, one or more trip pins may be carried on a rod having both right-hand and left-hand threads, where the trip pin(s) alternately engage the right-hand and left-hand threads to reverse direction of travel.

Figure 6:
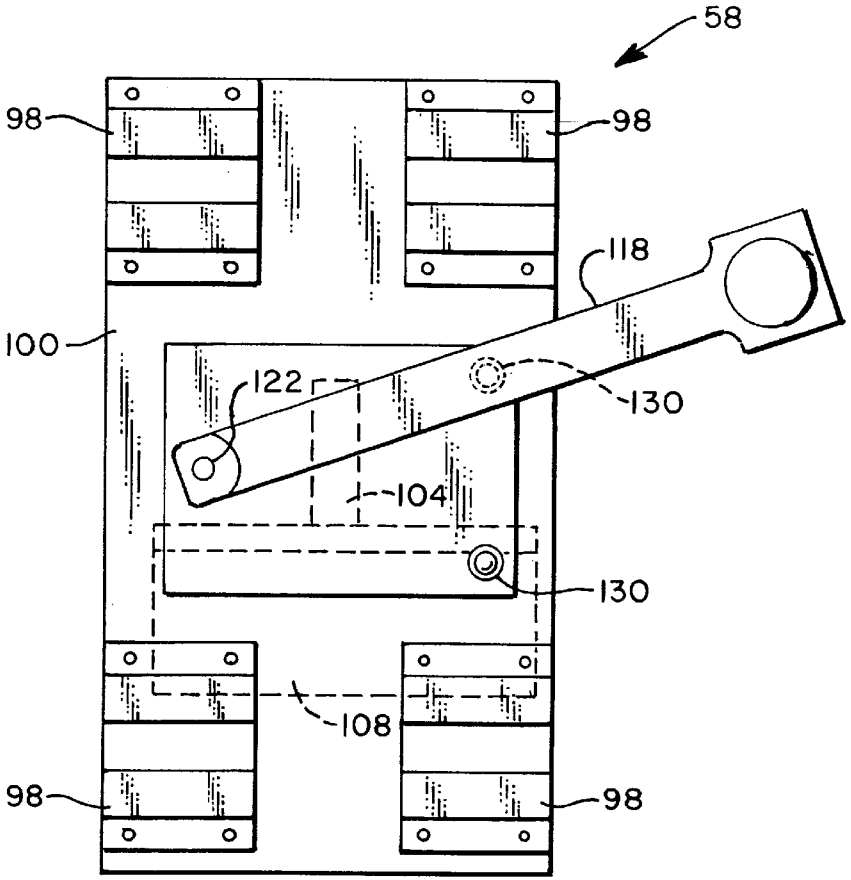
FIG. 6 is a side view of the means for detenting the link arm to the print head carriage assembly.
Figure 5:
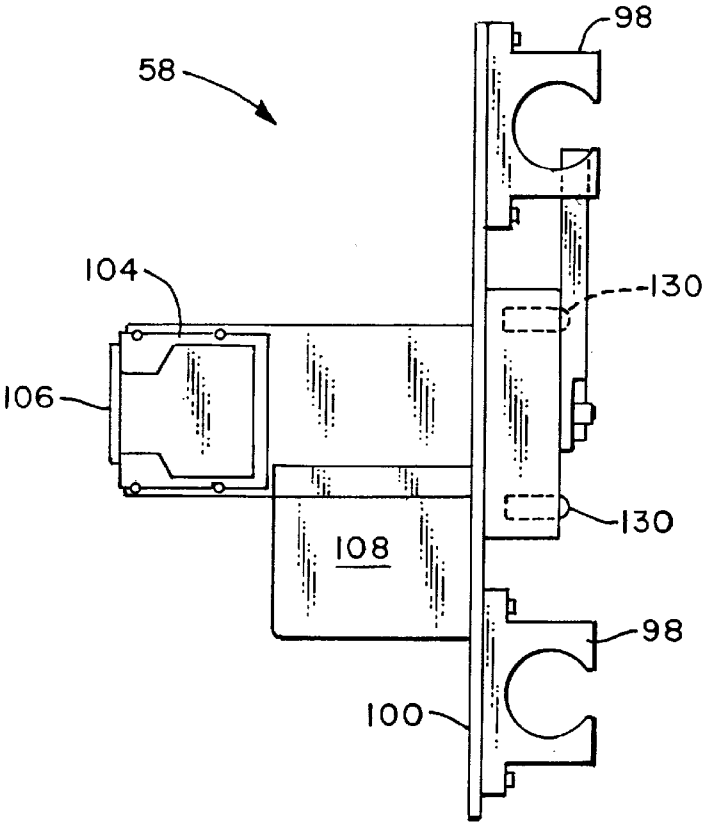
FIG. 5 is a plan view of the means for detenting the link arm to the print head carriage assembly.

The above-described setup enables the timing belt 88 to be driven continuously with the left end of the link arm 118, which is attached to the print carriage plate 100, remaining on centerline 124, while the other end of the link arm 118 follows the timing belt path by pivoting around the trip pin link bearing 120. The continuous rotation of the link arm 118 on the trip pin link bearing 120 creates a reciprocating linear motion of the print head carriage assembly 58. The length of linear travel is determined by the center distance between the print head idler and drive pulleys 84, 86 and the their pitch diameter. Printing occurs while the primary trip pin 110 that holds the link arm 118 is moving along the horizontal section of the timing belt 88. In order to prevent sag and or vertical oscillation of the timing belt 88, which could incrementally impact the horizontal location of the print head carriage assembly 58 through the horizontal component of the movement of the link arm 118, a detenting mechanism is provided by means of the spring ball plungers 130 that detents the link arm 118 and the print head carriage plate 100 when the print head 104 is in the printable area. FIGS. 5 and 6 illustrate this detenting mechanism.

In order to print a horizontal line with the web 12 of paper in continuous linear motion, the print head 104 must travel across the web 12 of paper at an angle proportional to the ratio of the linear speed of the paper web 12 and the linear speed of the print head 104 traversing the paper web 12. This "print angle" is positive for the print head 104 moving from left to right and negative for the print head 104 moving from right to left. The sign of the print angle is set such that the angle of the linear guide rails 80, 82, relative to a horizontal line across the paper web 12, provides for a displacement of the print head 104 in the same direction as the paper motion an amount equal to the paper displacement. Therefore, when looking at the linear guide rails 80, 82 from the front of the printer 10, with the print head 104 moving from left to right and the paper web 12 moving from the bottom to the top of the printer 10, the angle for the linear guide rails 80, 82 is positive and provides a vertical component of motion for the print head 104 which tracks the paper movement. When the traversing motion reverses direction and the print head 104 moves from the right to the left, the angle for the linear guide rails 80, 82 is negative again providing a vertical component of motion for the print head 104 which continues to track the paper movement. The center of the pivoting action for the linear guide rails 80, 82 is at the center of the maximum printable width across the paper web 12 using pivot shaft 72.

Figure 7:
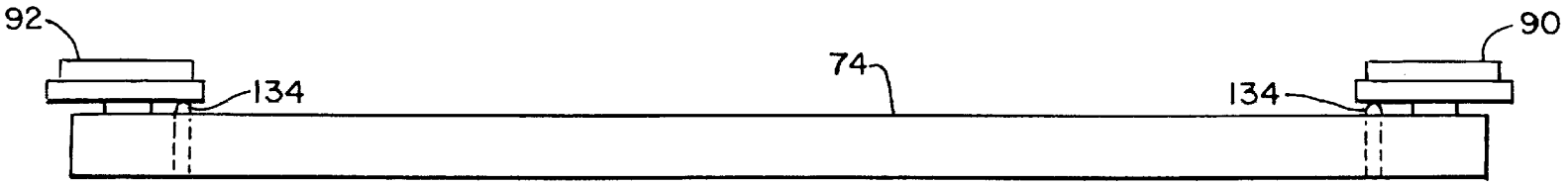
FIG. 7 is a top view of the pivoting beam and cams illustrating the means for detenting the cams to the pivoting beam.

While the print head carriage assembly 58 traverses from left to right, the two eccentric cams 90, 92 are positioned as shown in FIG. 3, with the left eccentric cam 92 having the smaller radius of the eccentric resting on the left cam support 96 and the right eccentric cam 90 having the larger radius of the eccentric resting on the right cam support 94. These cam supports 96, 94 are fixed in position on the fixed beam 76 using mounting plates 132 (FIG. 1). As the timing belt 88 rotates clockwise, the trip pins 110, 112 eventually reach their respective drive pulleys 84, 86 and begin to rotate around the pulleys 84, 86 causing the trip pins 110, 112 to engage with and rotate the eccentric cams 90, 92 by 180 degrees. The cam rotation is very smooth and close to sinusoidal in motion resulting in a very low acceleration load on the print head 104 during each direction reversal. The shape of the eccentric cams 90, 92 rotating over the cam supports 94, 96 gradually repositions the pivot beam 74 to the negative print angle required for printing from right to left. The eccentric cams 90, 92 are detented in the print position by two cam detent ball springs 134, shown in FIG. 7, as the trip pins 110, 112 exit the pulleys 84, 86 and the print head 104 moves into the print position. The two cam detent ball springs 134 are rigidly supported by the pivot beam 74.

It should be appreciated that the link arm 118 imparts a force F on the print carriage assembly 58 having a vector component Fx in the direction of movement of the timing belt 88 and a vector component Fy which is perpendicular to direction of movement of the timing belt 88. The link arm 118 and the horizontal center line 124 define an angle $\theta$. Increasing the length of the link arm 118 reduces the value of angle $\theta$, decreasing Fy and increasing Fx, thereby increasing the efficiency of the apparatus. Conversely, reducing the length of the link arm 118 increases the value of angle $\theta$, increasing Fy and decreasing Fx, thereby decreasing the efficiency of the apparatus. Therefore, the minimum length of the link arm 118 is constrained by efficiency factors.

It should also be appreciated that the print head carriage assembly 58 is laterally offset from the primary trip pin 110 by the distance between cam actuating bearing 114 and carriage support bearing 122. Consequently, when the print head carriage assembly 58 traverses from left to right, the primary and secondary trip pins 110, 112 engage the right and left eccentric cams 90, 92 respectively, after the print head carriage assembly 58 completes its travel through the print area. Conversely, the print head carriage assembly 58 completes its travel through the print area when traversing from right to left before the primary and secondary trip pins 110, 112 engage the left and right eccentric cams 92, 90, respectively. In the case where the frame width is fixed, the maximum length of the link arm 118 is constrained by the ability to compensate for the offset between the primary trip pin 110 and the print head carriage assembly 58, as explained below. In the case where the frame width is not fixed, the only constraint is that pivot 72 must be on the center of print head stroke.

For frames having a fixed width, the offset between the primary trip pin 110 and the print head carriage assembly 58 may be compensated for by moving the pivot beam 74 a distance to the right which is equal to the length of the offset.

As best shown in FIGS. 1 and 3, the pivot shaft 72 is located at a position which is at the center of print head stroke and at a position which is to the left of the midpoint 140 of the pivot beam 74. Further, the left end portion 142 of the pivot beam 74 is located at a position which is to the right of the left-hand edge of the paper web 12 and the right end portion 144 of the pivot beam 74 is located at a position which is to the right of the right-hand edge of the paper web 12. Consequently, the print head 104 is positioned at one of the print margins of the paper web 12 when the print head carriage assembly 58 completes each traversing pass.

Printing occurs when any one or more of the nozzles 106 on the print head 104 is fired. In a preferred embodiment, print head 104 has 128 vertical nozzles 106, providing a vertical print band which is 0.691 inches high. As the print head 104 traverses across the paper web 12, the nozzles 106 repeatedly fire based on an encoder count determined by the rate of pulses provided by the encoder 32. The maximum acceleration or "g-force" limitation for the print head 104 is not a limitation in this design since the maximum acceleration experienced by the print head carriage assembly 58 (which is reached at the end of it's cycle for each traversing pass) is well below this limitation. The maximum g force experienced by the print head 104 may further be kept below the maximum allowable g force by increasing the diameter of the idler and drive pulleys 84, 86. Since the paper web 12 and the print head 104 are physically interlocked to a single motor 16, a change in motor speed results in proportional changes to the paper movement, print head movement, and frequency of the encoder generated firing pulses. Therefore, the horizontal print density and the accuracy of the printed horizontal line is independent of the actual motor speed. In other system, which utilize servo mechanisms for each axis, the print head speed and inertial loads must be limited to maintain print accuracy.

Figure 8:
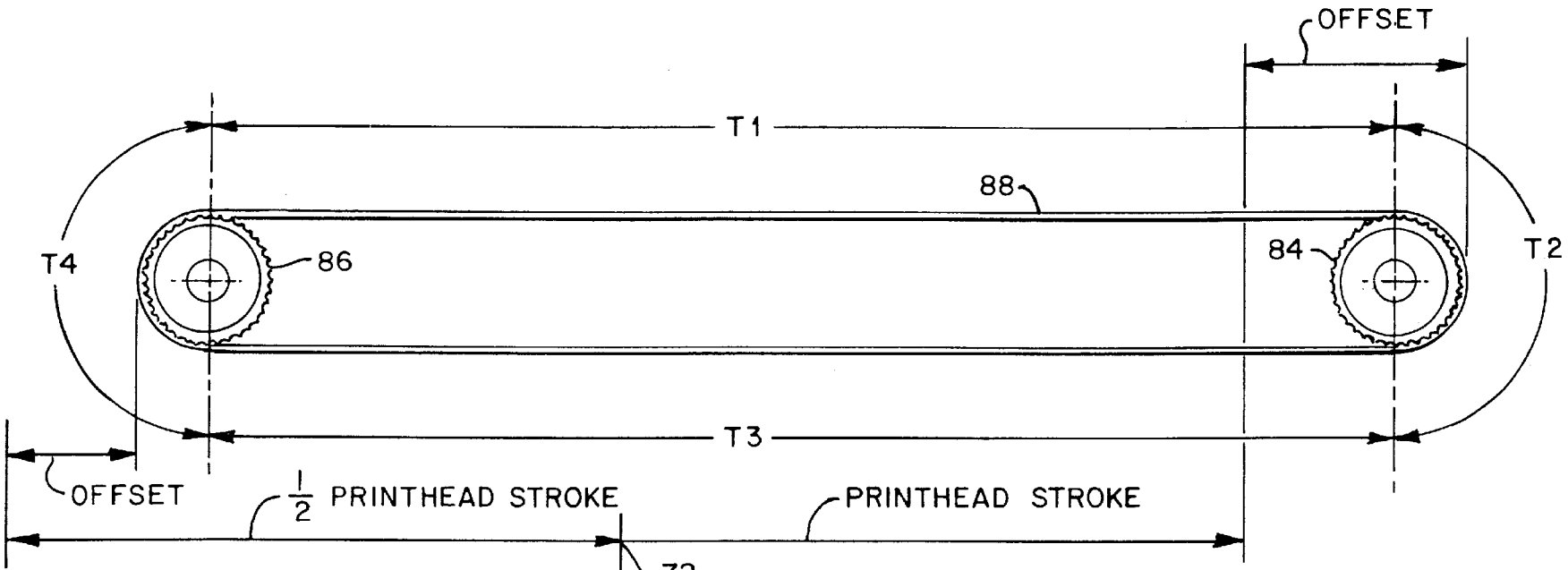
FIG. 8 is a plan view of the timing belt and pulleys dimensioned to identify the various timing regions defined for the printer.

For each complete revolution of the timing belt 88, the printer 10 will generate two sequential and contiguous print passes, each of the print passes having a height of 0.691 inches. As shown in FIG. 8, each complete revolution of the timing belt 88 can be divided into four regions, based upon the position of the primary trip pin 110. Regions T1 and T3 represent printable regions and regions T2 and T4 represent unprintable regions. The length of each region can be defined by the number of timing belt pitches or teeth in each region. In the preferred embodiment, the entire timing belt 88 has 400 teeth, with regions T1 and T3 each containing 185 teeth, and regions T2 and T4 each containing 15 teeth.

Since one revolution of the belt 88 is equal to 2×0.691 inches or 1.382 inches of vertical paper displacement, then T1 and T3 each represent (185/200)×0.691 inches or 0.639 inches of paper displacement while printing lines either left or right and T2 and T4 each represent (15/200)×0.691 inches or 0.052 inches of paper displacement and is the time it takes for the print head 104 to reverse direction and for the pivot beam 74 to reposition to the print angle. The sum of the paper displacement in the T1 region and the T2 region is equal to the vertical print height or 0.691 inches. Similarly, the sum of the paper displacement in the T3 region and the T4 region is 0.691 inches. Since the printer 10 can print during the T1 and T3 time, the maximum print efficiency for this printer 10 is ((T1+T3)/(T1+T2+T3+T4))×100=92.5%. This is a significant improvement over traditional printer systems and does not change as the speed of the printer is increased. This embodiment uses a configuration where T2 and T4 are equal. Other embodiments are practical using unequal regions. For a given width printer 10, running the motor 16 will result in an increased throughput without a loss of efficiency.

The timing belt 88 rotates clockwise when viewing the machine from the front. The print head 104 is parked at it's "home" position prior to moving. When the print head 104 begins to move for printing left to right, the left sensor 146, shown in FIG. 3, detects the start of the print line by sensing a flag 148 attached to the print head carriage plate 100. moving from left to right. The printer controller 60 then provides a programmable delay based upon encoder counts required to produce the left side print margin the user selects. Following this delay, the printer controller 60 uses the encoder pulses to generate firing pulses for the print head for one complete horizontal print band. After the trip pins 110, 112 rotate the eccentric cams 90, 92 and reverses. the angle of the pivot beam 74 for printing from right to left, the direction of the print head carriage assembly 58 is reversed. The printing begins again from right to left after the right sensor 150 detects the carriage flag 148. The left and right sensors 146, 150 are located at a position which is immediately after the trip pin 110, 112 comes off the pulley 84, 86 to eliminate encoder variations due to backlash and non-linearity in the pulley region.

The advantages of this invention is that only a single drive motor 16 is required for the entire system. This motor 16 requires a fraction of the power of conventional printer systems because of the elimination of the high accelerations and decelerations by using a unidirectional continuous motion drive traversing the print head carriage assembly 58. The effective speed for this system is only limited by the maximum print head firing rate.

The high-resolution encoder 32 may alternatively be coupled to motor 16. As the print head 104 traverses across the paper web 12, the nozzles 106 repeatedly fire based on an encoder count determined by the rate of pulses provided by the encoder 32, the motor gear ratio, the ratio of the number of teeth on the primary drive sprocket 66 to the number of teeth on the driven sprocket 66, and the pitch diameter of the driver pulley 86.

There are many other embodiments possible for this invention. The actuation function performed by the eccentric cams 90, 92 can be replaced by other actuators, including solenoids and hydraulics, controlled by either the mechanical position of the timing belt 88 or by electronic sensors and/or counters. The basic concept that is present in all embodiments is the use of a pivoting beam 74 for establishing the positive and negative print angle for each reciprocating direction of the print head 104. These alternative embodiments eliminate the requirement for independent x and y drives by means of positioning the print head guidance system at the required print angle for each traversing direction.

In other embodiments, multiple print head configurations can also be used. These heads can be positioned one over the other, staggered side-by-side, or evenly spaced across the width of the web 12 of paper in order to increase the band being printed on each traversing path or to increase the frequency with which the overall print pattern can be fired.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A printer for printing on a web of material moving continuously in a single direction along a linear path, the web having a printable area, the printer comprising:

a pivot beam extending orthogonally across and adjacent to the linear path of the web, the pivot beam having oppositely disposed first and second end portions;

first and second cam supports fixedly positioned proximate to the first and second end portions of the pivot beam;

first and second eccentric cams rotatably mounted at the first and second end portions of the pivot beam, respectively, and engaged with the first and second cam supports, respectively, the first and second eccentric cams each having a cam lobe, each of the cam lobes having a position, the position of the cam lobe of the second eccentric cam being located 180° from the position of the cam lobe of the first eccentric cam;

a print head carriage assembly supported on the pivot beam including at least one print head, the print head carriage assembly being moveable along the pivot beam from a first end position adjacent the first end portion of the pivot beam to a second end position adjacent the second end portion of the pivot beam;

a drive pulley and an idler pulley rotatably mounted at the first and second end portions of the pivot beam, respectively;

drive means for driving the drive pulley;

a drive belt carried on the drive and idler pulleys and driven by the drive pulley in a single direction;

linkage means connected to the drive belt and the print head carriage assembly for reciprocally pushing and pulling the print head carriage assembly between the first and second end positions; and trip means connected to the drive belt for selectively rotating the first and second eccentric cams, whereby the cam lobe of the first eccentric cam engages the first cam support to pivot the first end portion of the pivot beam in the direction of the linear path when the print head carriage assembly is disposed for moving from the second end position to the first end position and the cam lobe of the second eccentric cam engages the second cam support to pivot the second end portion of the pivot beam in the direction of the linear path when the print head carriage assembly is disposed for moving from the first end position to the second end position.

2. The printer of claim 1 wherein the trip means comprises first and second trip pins located 180° apart from one another on the drive belt, each of the trip pins having a cam actuating bearing engageable with the first and second eccentric cams.

3. The printer of claim 2 wherein the linkage means comprises a link arm having oppositely disposed first and second end portions, the first end portion being pivotally connected to the first trip pin and the second end portion being pivotally connected to the print head carriage assembly at a position on a plane defined by the axis of the idler and drive pulleys.

4. The printer of claim 3 wherein the pivot beam includes first and second guide rails mounted to the pivot beam and the print head carriage assembly also includes a carriage plate slidably mounted to each of the guide rails by at least one linear bearing.

5. The printer of claim 4 wherein the print head carriage assembly further includes detent means for detenting the link arm and the carriage plate when the print head is disposed in the printable area of the web, the detent means including upper and lower spring ball plungers.

6. A printer for printing on a web of material moving continuously in a single direction along a linear path, the printer comprising:

a pivot beam extending orthogonally across and adjacent to the linear path of the web, the pivot beam having oppositely disposed first and second end portions;

a print head carriage assembly supported on the pivot beam including at least one print head, the print head carriage assembly being moveable along the pivot beam from a first end position adjacent the first end portion of the pivot beam to a second end position adjacent the second end portion of the pivot beam;

drive means connected to the print head carriage assembly for reciprocally pushing and pulling the print head carriage assembly between the first and second end positions;

actuator means for selectively pivoting the first end portion of the pivot beam in the direction of the linear path when the print head carriage assembly is disposed for moving from the second end position to the first end position and pivoting the second end portion of the pivot beam in the direction of the linear path when the print head carriage assembly is disposed for moving from the first end position to the second end position.

7. A printer for printing on a web of material moving in a single direction along a linear path, the linear path having oppositely disposed left and right sides, the printer comprising:

a frame having fixed left and right members adapted for straddling the linear path;

a feed drum rotatably mounted to the left and right members of the frame, the feed drum having an outer surface adapted for frictionally engaging and pulling web material along the linear path;

drive means coupled to the feed drum for rotating the feed drum;

print means adapted for printing on the web of material;

a take-up shaft having an outer surface adapted for mounting a leading end of the web of material extending between the take-up shaft and the feed drum and winding the web material thereon; and first free floating mounting means for moveably mounting the take-up shaft to the left and right members of the frame, the first free floating mounting means comprising a first pendulum system having first and second pendulum arms, each of the pendulum arms having oppositely disposed first and second end portions, the first end portions of the first and second pendulum arms being independently pivotally mounted to the left and right members of the frame, respectively, the take-up shaft being rotatably mounted to the second end portions of the first and second pendulum arms;

wherein, web material wound on the take-up shaft runs in contact with the feed drum, whereby the displacement of the web exiting the feed drum is equal to the displacement of the paper winding on the take-up shaft, winding the web with minimal tension.

8. A printer for printing on a web of material moving in a single direction along a linear path, the linear path having oppositely disposed left and right sides, the printer comprising:

a frame having fixed left and right members adapted for straddling the linear path;

a feed drum rotatably mounted to the left and right members of the frame, the feed drum having an outer surface adapted for frictionally engaging and pulling web material along the linear path;

drive means coupled to the feed drum for rotating the feed drum;

print means adapted for printing on the web of material;

a take-up shaft having an outer surface adapted for mounting a leading end of the web of material extending between the take-up shaft and the feed drum and winding the web material thereon;

first free floating mounting means for moveably mounting the take-up shaft to the left and right members of the frame;

a supply shaft rotatably mounted to the left and right members of the frame, the supply shaft being adapted for rotatably mounting a supply roll of web material;

a paper tension roller having an outside surface adapted for engaging the web material disposed intermediate the supply shaft and the feed drum; and a second free floating mounting means for moveably mounting the paper tension roller to the left and right members of the frame;

wherein, web material wound on the take-up shaft runs in contact with the feed drum, whereby the displacement of the web exiting the feed drum is equal to the displacement of the paper winding on the take-up shaft, winding the web with minimal tension.

9. The printer of claim 8 wherein the second free floating mounting means comprises a second pendulum system having third and fourth pendulum arms, each of the pendulum arms having oppositely disposed first and second end portions, the first end portions of the third and fourth pendulum arms being independently pivotally mounted to the left and right members of the frame, respectively, the paper tension roller being rotatably mounted to the second end portions of the third and fourth pendulum arms.

10. A printer for printing on a web of material moving continuously in a single direction along a linear path, the web having a printable area, the printer comprising:

a frame;

a single motor;

a feed drum rotatably mounted to the frame, the feed drum having an outer surface adapted for frictionally engaging and pulling web material along the linear path;

first drive means coupling the motor to the feed drum for rotating the feed drum;

a take-up shaft having an outer surface adapted for mounting a leading end of the web of material extending between the take-up shaft and the feed drum and winding the web material thereon;

a supply shaft rotatably mounted to the frame, the supply shaft being adapted for rotatably mounting a supply roll of web material;

a paper tension roller having an outside surface adapted for engaging the web material disposed intermediate the supply shaft and the feed drum;

free floating mounting means for moveably mounting the take-up shaft and the paper tension roller to the frame a pivot beam extending orthogonally across and adjacent to the linear path of the web, the pivot beam having oppositely disposed first and second end portions;

a print head carriage assembly supported on the pivot beam including at least one print head, the print head carriage assembly being moveable along the pivot beam from a first end position adjacent the first end portion of the pivot beam to a second end position adjacent the second end portion of the pivot beam;

second drive means coupling the motor to the print head carriage assembly for reciprocally pushing and pulling the print head carriage assembly between the first and second end positions;

actuator means for selectively pivoting the first end portion of the pivot beam in the direction of the linear path when the print head carriage assembly is disposed for moving from the second end position to the first end position and pivoting the second end portion of the pivot beam in the direction of the linear path when the print head carriage assembly is disposed for moving-from-the first end position to the second end position.

11. A printer for printing on a web of material moving continuously in a single direction along a linear path having first and second oppositely disposed sides, the web having a printable area, the printer comprising:

a single motor;

a frame;

advance means adapted for providing motive power for advancing the web of material along the linear path, the advance means comprising a feed drum rotatably mounted to the frame, the feed drum having an outer surface adapted for frictionally engaging and pulling web material along the linear path, first drive means coupling the single motor to the advance means for supplying the motive power to the advance means;

print means adapted for printing on the web of material along a print path extending across the linear path between a first end position adjacent the first side of the linear path and a second end position adjacent the second side of the linear path;

second drive means coupling the single motor to the print means for reciprocally pushing and pulling the print means between the first and second end positions; and tensioning means adapted for tensioning the web of material as it is advanced by the advance means, the tensioning means comprising a take-up shaft and first free floating mounting means for moveably mounting the take-up shaft to the frame, the take-up shaft having an outer surface adapted for mounting a leading end of the web of material extending between the take-up shaft and the feed drum and winding the web material thereon.

12. The printer of claim 11 wherein the first free floating mounting means comprises a first pendulum system having first and second pendulum arms, each of the pendulum arms having oppositely disposed first and second end portions, the first end portions of the first and second pendulum arms being independently pivotally mounted to the frame, respectively, the take-up shaft being rotatably mounted to the second end portions of the first and second pendulum arms.

13. The printer of claim 11 wherein the advance means further comprises a supply shaft rotatably mounted to the frame, the supply shaft being adapted for rotatably mounting a supply roll of web material, and the tensioning means further comprises a paper tension roller and second free floating mounting means for moveably mounting the paper tension roller to the frame, the paper tension roller having an outside surface adapted for engaging the web material disposed intermediate the supply shaft and the feed drum.

14. The printer of claim 13 wherein the second free floating mounting means comprises a second pendulum system having third and fourth pendulum arms, each of the pendulum arms having oppositely disposed first and second end portions, the first end portions of the third and fourth pendulum arms being independently pivotally mounted to the frame, respectively, the paper tension roller being rotatably mounted to the second end portions of the third and fourth pendulum arms.

15. A printer for printing on a web of material moving continuously in a single direction along a linear path having first and second oppositely disposed sides, the web having a printable area, the printer comprising:

a single motor;

advance means adapted for providing motive power for advancing the web of material along the linear path;

first drive means coupling the single motor to the advance means for supplying the motive power to the advance means;

print means adapted for printing on the web of material along a print path extending across the linear path between a first end position adjacent the first side of the linear path and a second end position adjacent the second side of the linear path, the print means comprising a pivot beam extending orthogonally across and: adjacent to the linear path of the web, the pivot beam having oppositely disposed first and second end portions;

at least one print head supported on the pivot beam, the print head being moveable along the pivot beam between the first and second end positions; and actuator means for selectively pivoting the first end portion of the pivot beam in the direction of the linear path when the print head is disposed for moving from the second end position to the first end position and pivoting the second end portion of the pivot beam in the direction of the linear path when the print head is disposed for moving from the first end position to the second end position; and second drive means coupling the single motor to the print means for reciprocally pushing and pulling the print means between the first and second end positions.

16. The printer of claim 15 wherein the second drive means comprises:

a drive pulley and an idler pulley rotatably mounted at the first and second end portions of the pivot beam, respectively;

coupling means for coupling the single motor to the drive pulley;

a drive belt carried on the drive and idler pulleys and driven by the drive pulley in a single direction; and linkage means connected to the drive belt and the print means for reciprocally pushing and pulling the print head between the first and second end positions.

17. The printer of claim 16 wherein the actuator means comprises first and second cam supports fixedly positioned proximate to the first and second end portions of the pivot beam;

first and second eccentric cams rotatably mounted at the first and second end portions of the pivot beam, respectively, and engaged with the first and second cam supports, respectively, the first and second eccentric cams each having a cam lobe, each of the cam lobes having a position, the position of the cam lobe of the second eccentric cam being located 180° from the position of the cam lobe of the first eccentric cam; and trip means connected to the drive belt for selectively rotating the first and second eccentric cams, whereby the cam lobe of the first eccentric cam engages the first cam support to pivot the first end portion of the pivot beam in the direction of the linear path when the print head is disposed for moving from the second end position to the first end position and the cam lobe of the second eccentric cam engages the second cam support to pivot the second end portion of the pivot beam in the direction of the linear path when the print head carriage assembly is disposed for moving from the first end position to the second end position.

18. The printer of claim 17 wherein the trip means comprises first and second trip pins located 180° apart from one another on the drive belt, each of the trip pins having a cam actuating bearing engageable with the first and second eccentric cams.

19. The printer of claim 18 wherein the actuator means further comprises detent means for detenting the first and second eccentric cams in a print position as the first and second trip pins exit the drive and idler pulleys and the print head moves into the print position.

20. The printer of claim 19 wherein the detent means comprises a pair of cam detent ball springs rigidly supported on the pivot beam.

21. The printer of claim 16 wherein the print means further comprises a carriage assembly and the linkage means comprises a link arm, the print head being mounted on the carriage assembly, the link arm having oppositely disposed first and second end portions, the first end portion being pivotally connected to the first trip pin and the second end portion being pivotally connected to the carriage assembly at a position on a plane defined by the axis of the idler and drive pulleys.

22. The printer of claim 21 wherein the pivot beam includes first and second guide rails mounted to the pivot beam and the carriage assembly also includes a carriage plate slidably mounted to each of the guide rails.

* * * * *